US011236606B2

(12) United States Patent
Pridat et al.

(10) Patent No.: US 11,236,606 B2
(45) Date of Patent: Feb. 1, 2022

(54) WIRELESS COMMUNICATION BETWEEN DOWNHOLE COMPONENTS AND SURFACE SYSTEMS

(71) Applicants: Lars Pridat, Hannover (DE); Gavin Lindsay, Kuala Lumpur (MY); Kai Schoenborn, Lachendorf (DE)

(72) Inventors: Lars Pridat, Hannover (DE); Gavin Lindsay, Kuala Lumpur (MY); Kai Schoenborn, Lachendorf (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 112 days.

(21) Appl. No.: 15/450,722

(22) Filed: Mar. 6, 2017

(65) Prior Publication Data

US 2018/0252095 A1 Sep. 6, 2018

(51) Int. Cl.

| | |
|---|---|
| ***E21B 47/13*** | (2012.01) |
| ***E21B 47/00*** | (2012.01) |
| ***E21B 47/12*** | (2012.01) |
| ***G01V 3/30*** | (2006.01) |

(52) U.S. Cl.
CPC ..... *E21B 47/13* (2020.05)

(58) Field of Classification Search
CPC ..... E21B 47/122; E21B 47/13
See application file for complete search history.

(56) References Cited

U.S. PATENT DOCUMENTS

| | | | |
|---|---|---|---|
| 5,107,705 | A | 4/1992 | Wraight et al. |
| 5,589,825 | A | 12/1996 | Pomerleau |
| 6,990,045 | B2 | 1/2006 | Jackson |
| 7,598,886 | B2 | 10/2009 | Hall et al. |
| 8,955,602 | B2 | 2/2015 | Pilgrim |

(Continued)

FOREIGN PATENT DOCUMENTS

| | | | |
|---|---|---|---|
| WO | 2007019292 | A2 | 2/2007 |
| WO | 2014146207 | A1 | 9/2014 |

OTHER PUBLICATIONS

Bussmann, Cooper; Wireless Solutions for Upstream and DownStream Applications; Sep. 2015; Retrieved from the internet;http://www.cooperindustries/com/content/dam/public/bussmann/Wireless/Resources/Brochure/bus-wir-br-10125-oil-gas.pdf;7 pages.

(Continued)

*Primary Examiner* — Joseph H Feild
*Assistant Examiner* — Pameshanand Mahase
(74) *Attorney, Agent, or Firm* — Cantor Colburn LLP

(57) ABSTRACT

An embodiment of a communication system for communicating between a wired pipe string in a borehole and a surface location includes at least a first wired pipe downhole component and a second wired pipe downhole component in the wired pipe string, a coupler configured to transmit a transmission signal between the first wired pipe downhole component and the second wired pipe downhole component, and a wireless transmission assembly in at least one of the first wired pipe downhole component and the second wired pipe downhole component. The wireless transmission assembly is configured to wirelessly transmit a wireless transmission signal to a receiver antenna, and the receiver antenna is disposed at the surface location and configured to receive the wireless transmission signal.

20 Claims, 10 Drawing Sheets

(56) References Cited

U.S. PATENT DOCUMENTS

2003/0129978 A1* 7/2003 Akiyama ..... H04L 12/5692 455/426.1
2007/0257811 A1 11/2007 Hall et al.
2008/0007425 A1 1/2008 Hall et al.
2009/0173538 A1* 7/2009 Estes ..... E21B 47/00 175/24
2010/0213942 A1 8/2010 Lazarev
2011/0241897 A1 10/2011 Haynes et al.
2013/0176139 A1* 7/2013 Chau ..... G01V 3/30 340/854.4
2013/0255966 A1 10/2013 Palaghita et al.
2014/0083768 A1* 3/2014 Moriarty ..... E21B 47/122 175/40
2014/0174729 A1 6/2014 Spesivtsev et al.
2015/0021016 A1 1/2015 Deng et al.
2015/0061885 A1 3/2015 Mueller et al.
2016/0209536 A1* 7/2016 Song ..... E21B 47/14
2016/0291190 A1* 10/2016 Huang ..... E21B 47/01
2016/0300484 A1* 10/2016 Torbett ..... E21B 47/122
2016/0340987 A1 11/2016 Prammer
2017/0160422 A1* 6/2017 Donderici ..... G01V 3/28
2017/0370151 A1* 12/2017 Banirazi-Motlagh ..... E21B 7/04

OTHER PUBLICATIONS

Gao, Yan; "Sdvl.Technology"; Sep. 2015; Retrieved from the internet http://sdvl.synthasite.com/index.phtp; 3 pages.
International Search Report for International Application No. PCT/US2018/021100; dated Jun. 19, 2018; 3 Pages.
Written Opinion of the International Search Report for International Application No. PCT/US2018/021100; dated Jun. 19, 2018; 8 Pages.

* cited by examiner

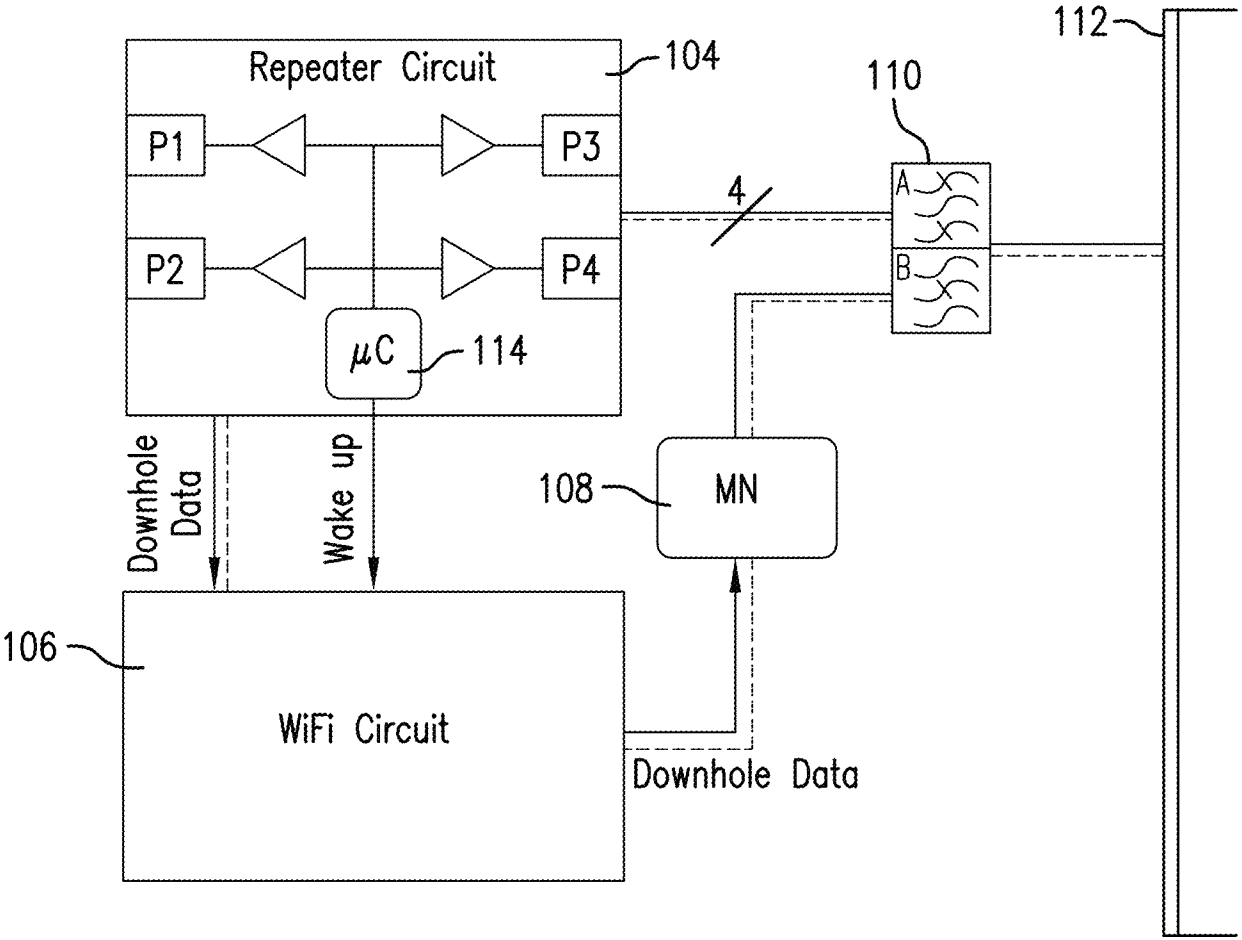
FIG. 7
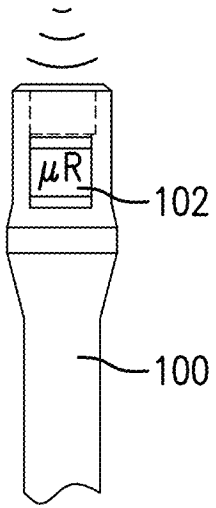

WIRELESS COMMUNICATION BETWEEN DOWNHOLE COMPONENTS AND SURFACE SYSTEMS

BACKGROUND

During subterranean drilling and completion operations, various power and/or communication signals may be transmitted through pipe segments or other downhole components, e.g., via a "wired pipe" configuration. Such configurations include electrical, optical or other conductors extending along the length of selected pipe segments. The conductors are operably connected between pipe segments by a variety of coupling configurations, and are typically connected to a surface system using a surface communication sub or other interface on the uppermost pipe with a cable connection to the surface system.

In a number of situations, pipe segments and downhole components are disconnected from the surface system and are unable to communicate with downhole components. Such situations include, for example, connection of a new pipe segment and tripping or removal of a downhole string.

For example, pipe connections typically take a few minutes to perform, during which time no information is received from downhole instrumentation. A round trip from 5000 meters (e.g. changing drilling assembly) may involve upwards of 300 connections, during which there is an increased risk of undetected formation fluid influxes, stuck pipe events and other changes to the borehole. Pipe connections also represent a significant amount of down time, during which no data is received from downhole instruments, and an opportunity for optimization.

SUMMARY

An embodiment of a communication system for communicating between a wired pipe string in a borehole and a surface location includes at least a first wired pipe downhole component and a second wired pipe downhole component in the wired pipe string, s coupler configured to transmit a transmission signal between the first wired pipe downhole component and the second wired pipe downhole component, and a wireless transmission assembly in at least one of the first wired pipe downhole component and the second wired pipe downhole component. The wireless transmission assembly is configured to wirelessly transmit a wireless transmission signal to a receiver antenna, and the receiver antenna is disposed at the surface location and configured to receive the wireless transmission signal.

An embodiment of a method of communicating between a wired pipe string in a borehole and a surface location includes disposing the wired pipe string in a borehole in an earth formation and connecting the wired pipe string to surface equipment. The wired pipe string includes at least a first wired pipe downhole component and a second wired pipe downhole component, and a coupler configured to transmit a transmission signal between the first wired pipe downhole component and the second wired pipe downhole component. The method also includes transmitting a wireless transmission signal from a wireless transmission assembly in at least one of the first wired pipe downhole component and the second wired pipe downhole component, the wireless transmission signal transmitted to a receiver antenna disposed at the surface location.

BRIEF DESCRIPTION OF THE DRAWINGS

The following descriptions should not be considered limiting in any way. With reference to the accompanying drawings, like elements are numbered alike:

FIG. 7 depicts an example of a communication device that includes circuitry for both short range communication and long range communication according to embodiments described herein;

DETAILED DESCRIPTION

Figure 1:
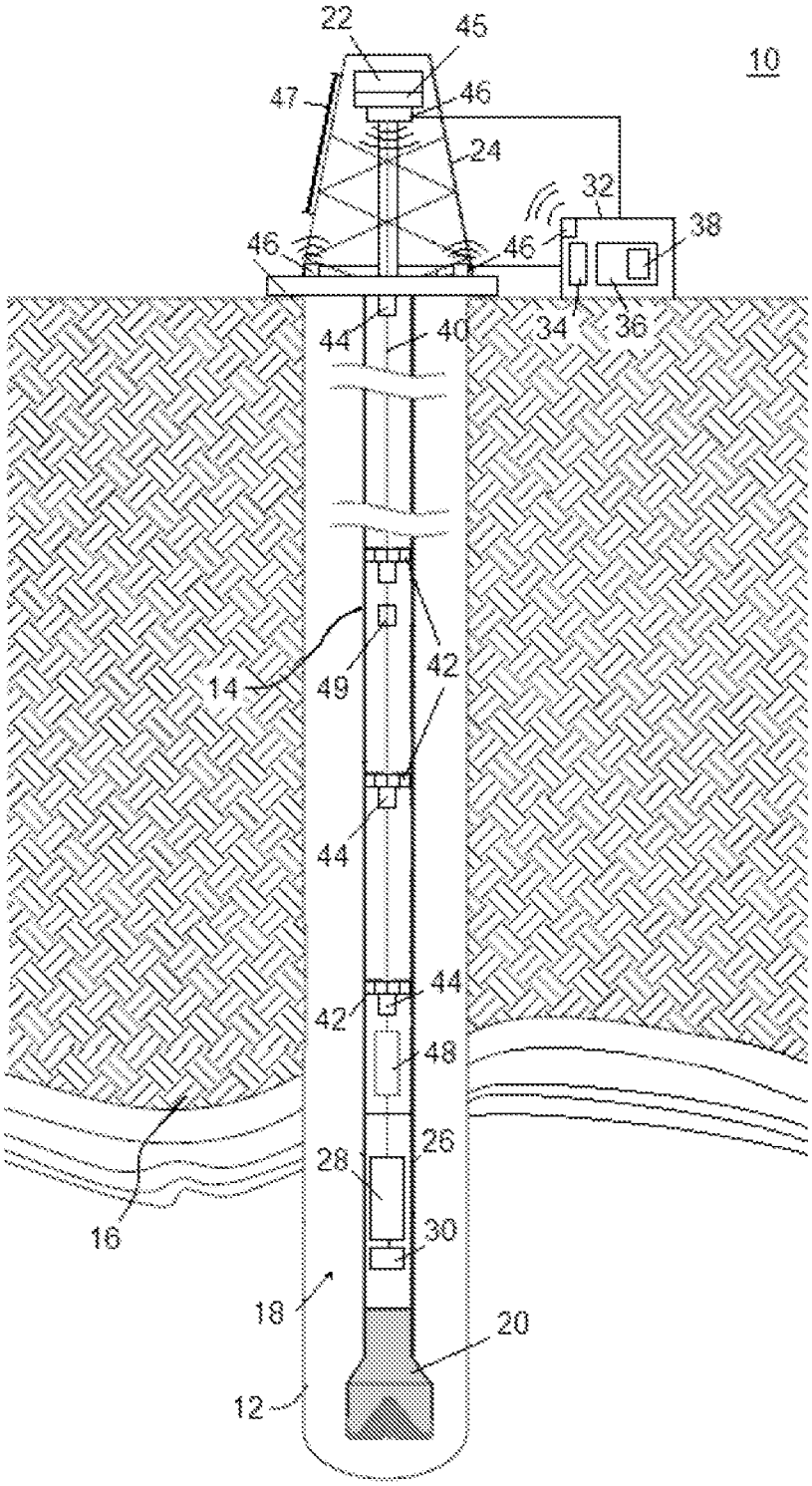
FIG. 1 depicts an embodiment of a drilling, measurement and/or hydrocarbon production system.

Referring to FIG. 1, an embodiment of a drilling, measurement and/or hydrocarbon production system 10 is shown. A borehole string 14 is disposed in a borehole 12, which penetrates at least one earth formation 16. Although the borehole 12 is shown in FIG. 1 to be of constant diameter, the borehole is not so limited. For example, the borehole 12 may be of varying diameter and/or direction (e.g., azimuth and inclination). A borehole string 14 is made from, for example, a pipe, multiple pipe sections or coiled tubing. The borehole string includes one or more downhole components, such as sensing or measurement devices, communication devices, drilling devices, steering or directional control devices and others. One or more downhole components may be disposed in or constitute a bottomhole assembly (BHA) 18.

Various components for drilling, measurement and other functions are disposed downhole by a carrier, such as a drilling assembly, string 14 and downhole tools, but are not so limited, and may be disposed with any suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, bottom-hole assemblies, and drill strings.

In one embodiment, the borehole string 14 is configured as a drillstring that connects a drilling assembly to surface equipment. The drilling assembly includes a drill bit 20 that is attached to the bottom end of the drillstring and is configured to be conveyed into the borehole 12 from a drilling rig at the surface. In the embodiment shown in FIG. 1, the drilling assembly and the drill bit 20 are rotated by a top drive 22 mounted on a derrick 24. The drilling assembly may be rotated by other means, such as a rotary table at the drilling rig, or a downhole motor such as a positive displacement motor (e.g., a mud motor) or a turbine motor.

Various measurement tools may also be incorporated into the system 10 to affect measurement regimes such as logging-while-drilling (LWD) or measurement-while-drilling (MWD) applications. Measurement tools and/or other tools can be placed or located at any selected locations along the borehole string 14, such as at a BHA or at other locations along the string. For example, the drillstring and/or BHA 18 includes a downhole tool 26 configured as a downhole measurement tool. In this example, the downhole tool 26 includes a sensing device 28 connected to a power source 30 such as a battery or an alternator. Exemplary devices include formation evaluation devices such as pulsed neutron tools, gamma ray measurement tools, neutron tools, resistivity tools, acoustic tools, nuclear magnetic resonance tools, density measurement tools, seismic data acquisition tools, acoustic impedance tools, formation pressure testing tools, fluid sampling and analysis tools, coring tools and/or any other type of sensor or device capable of providing information regarding properties of the borehole, downhole components and/or an earth formation, such as pressure sensors, magnetometers, accelerometers, temperature sensors, bending sensors, and cement evaluation sensors.

The BHA 18, tool 26 and/or other components of the string 14 include, or are connected to means for communicating signals to receivers such as a user and/or a processor located at a surface location or disposed downhole. For example, the drilling assembly including the drill bit 20 and/or tool 26 is connected in communication with a surface processing unit 32 or other processor, such as a surface control unit or a remote unit such as a data center. The surface processing unit 32 is configured to receive, store and/or transmit data and signals, and includes processing components configured to analyze data and/or control operational parameters. In one embodiment, the surface processing unit 32 is configured to control the drilling assembly and receive data from the tool 26 and any other downhole and/or surface sensors. Operational parameters may be controlled or adjusted automatically by the surface processing unit 32 in response to sensor data, or controlled by a human driller or remote processing device. The surface processing unit 32 includes any number of suitable components, such as processors, memory, communication devices and power sources. For example, the surface processing unit 32 may include a processor 34 (e.g., a microprocessor), and a memory 36 storing software 38. In addition or as an alternative to surface processors, processing capability may be located downhole, for example, as downhole electronics, which may perform all or some of the functions described in conjunction with the surface processing unit 32.

Signals and data may be transmitted via any suitable transmission device or system, such as various wireless configurations as described further below and wired communications. Techniques used to transmit signals and data include wired pipe, electric and/or fiber optic connections, mud pulse, electromagnetic and acoustic telemetry.

The surface processing unit 32 and other communication devices form a communication system or network that allows communication between downhole components and the surface during operation of the drillstring and during times when the drillstring is physically and/or electrically disconnected from the surface. In the embodiment of FIG. 1, the communication system is incorporated in a wired pipe system and may be referred to as a wired pipe network (WPN).

The communication system includes a conductor or conductor assembly such as a cable 40 for transmitting power and/or communications to and from the surface. A communication assembly is disposed at an end of each wired pipe downhole component, e.g., each tool and/or pipe segment. In one embodiment, the communication assembly is disposed at the upper end of each downhole component.

In one embodiment, each communication assembly includes a coupler 42 that provides an electrical connection between adjacent components and allows for transmission of communications between components and between the assembly's respective component and the surface processing unit 32. A "communication" is broadly defined herein as any information or electrical power transmitted between components, such as data, commands, instructions and/or electrical power. The electrical connection may be a wired or wireless connection that is configured to transmit communications within a relatively short range that is sufficient to enable communication between adjacent components. Communication signals configured to be transmitted within this range (e.g., via the coupler 42) are referred to as short range communications. The coupler 42, in one example, is an inductive coupler ring or other transmission device configured to transmit short range communications. In another example, the coupler 42 is a wireless transmitter/receiver antenna configured to transmit short range signals.

In some situations, the drillstring (or other borehole string) is disconnected from surface equipment, e.g., disconnected from a surface communication sub 45 and/or the top drive 22. This disconnection may occur during, e.g., connection of additional pipe segments or components to the drillstring and tripping (i.e., removal of the drillstring from a borehole or placement of the drillstring in a borehole). When the top drive and/or other surface equipment is disconnected from the drillstring, there is an increased risk of stuck pipe events and complexity in dealing with well control events due to the interruption to flow of drilling fluid and the resultant decrease in downhole pressure. Events such as stuck pipe or fluid influx (well control) cannot be detected using conventional wired pipe or other communications, as the drillstring is physically and electrically disconnected from surface equipment and processors (e.g., the surface communication sub 45 and/or surface processing unit 32). As a result, no data is received from downhole instrumentation and there is no real time monitoring of, e.g., swab/surge effects, and no indication as to how the formation is reacting to changes in pressure caused by pipe movement.

The communication system addresses the above challenges, and includes (in addition to the coupler 42 and/or other conventional communication devices), a wireless transmission assembly 44 in at least one wired pipe downhole component. The wireless transmission assembly includes a wireless transmitter. The wireless transmitter may be configured to both transmit to and receive wireless communications from a wireless transmitter disposed at the surface. For example, each wireless transmitter includes a wireless modem disposed at each component. The modem may be powered by a battery at the respective component or by a power source (e.g., the power source 30) located at a BHA, downhole tool, or interface device.

Each transmission assembly is configured to communicate with one or more surface transmitters/receivers, which are capable of receiving communications via a wireless transmission signal (e.g., Wi-Fi or radiofrequency (RF) signal) from the wireless transmitter in a wireless transmission assembly 44, when the downhole component associated with the wireless transmission assembly is at an uppermost position and/or when the drillstring is physically and electrically disconnected from the surface equipment (e.g., from the surface communication sub 45 or the top drive 22 or the surface processing unit 32). For example as shown in FIG. 1, one or more wireless transmitters/receivers 46 (e.g., wireless modems) are positioned at suitable locations on the drilling rig, such as at a safe area near a rotary table or sig floor, at or near the top drive, and/or on the derrick 24. In one embodiment, an antenna such as a lossy coaxial or leaky wave cable 47 is attached to the derrick.

The terms "upper", "lower" and "uppermost" as used herein refer to relative positions along a borehole and/or borehole string. For example, an upper location refers to a location that is a closer to the surface (e.g., a location where the borehole string connects to a surface rig or other equipment) than another location as measured from the surface along a longitudinal axis or path of the borehole and/or string. Likewise, a lower location refers to a location that is further from the surface than another location as measured along the axis of the borehole and/or string. An uppermost component is a component that is closest to the surface as measured along the axis and/or is physically connected to the surface during an operation. It is noted that these terms may not correspond with vertical depth in a formation. For example, in a deviated or horizontal borehole section, an upper component is closer to the surface than a lower component; however the vertical depth of the upper component could be the same as or greater than the vertical depth of the lower component.

The wireless transmission assembly 44 is configured to transmit communication signals having a range that is greater than the short range communication discussed above. The wireless transmission signal (e.g., RF signal) has a range that is large enough to be transmitted at least from the uppermost component to a surface receiver, such as a wireless transmitter/receiver 46 or the cable 47. Communication signals configured to be transmitted within this range (e.g., via the wireless transmission assembly 44) are referred to as long range communications.

The wireless transmission assembly 44 is or includes a conversion device that converts a transmission signal received from an adjacent downhole component to a long range signal. For example, an electronics component (e.g., printed circuit board) acts as a conversion device by receiving the transmission signal (which may be received as a short range signal from the adjacent component) and generating a long range signal, e.g., by demodulating the received signal and re-modulating the signal so that the signal is configured for long range transmission. In one embodiment, the long range signal has a frequency that is greater than the frequency of the short range signal.

Long range communications can be performed when a borehole string is attached to surface equipment such as a top drive and there is, e.g., a continuous fluid path from the surface to the borehole string. In addition, long range communications can be performed when the borehole string 14 is disconnected from the surface (e.g., the fluid flow path through the top drive is broken, and the short range transmission is broken at the uppermost connection, the surface communication sub is broken, and/or the communication to the surface communication sub is interrupted).

The communication system may be configured as part of a variety of different embodiments. For example, in place of or in addition to the wireless transmission assemblies 44 being disposed at each downhole component, a wireless transmission assembly may be configured as a communication cap to be placed inside/or next to the uppermost coupler 42 to convert a communication signal to a wireless transmission signal.

In one embodiment, the wireless transmission assemblies 44 include respective batteries or are connected to batteries at other downhole locations, so that the wireless transmission assemblies and downhole tools are always on, i.e., can be powered and operated when the drillstring is disconnected. In one embodiment the wireless transmission signal is a bi-directional wireless transmission assembly.

In one embodiment, the string 14 is a wired pipe string including at least a plurality of wired drill pipes or wired drill pipe segments, a downhole interface sub, and a BHA. Downhole components in this embodiment that are located above the downhole interface sub are referred to as wired pipe downhole components.

It is noted that, although the downhole components are discussed in various embodiments as wired pipe components, they are not so limited, as the embodiments may also apply to any suitable types of downhole components.

The communication system also includes a downhole processing device configured to control aspects of communication between downhole components and the surface. The downhole processing device may be incorporated in a downhole electronics sub or component, such as a wired pipe downhole component, or incorporated in downhole components such as a downhole tool or BHA. For example, the downhole processing device is incorporated at a downhole interface sub (DIS) 48 disposed adjacent to the BHA or lowermost pipe in the wired pipe downhole components. The DIS 48 (or other suitable processing device) performs various functions, such as receiving and transmitting data and communications, transmitting instructions to wireless communication assemblies and activating wireless transmission assemblies to switch between wired and wireless communications or short range and long range communications.

Figure 2:
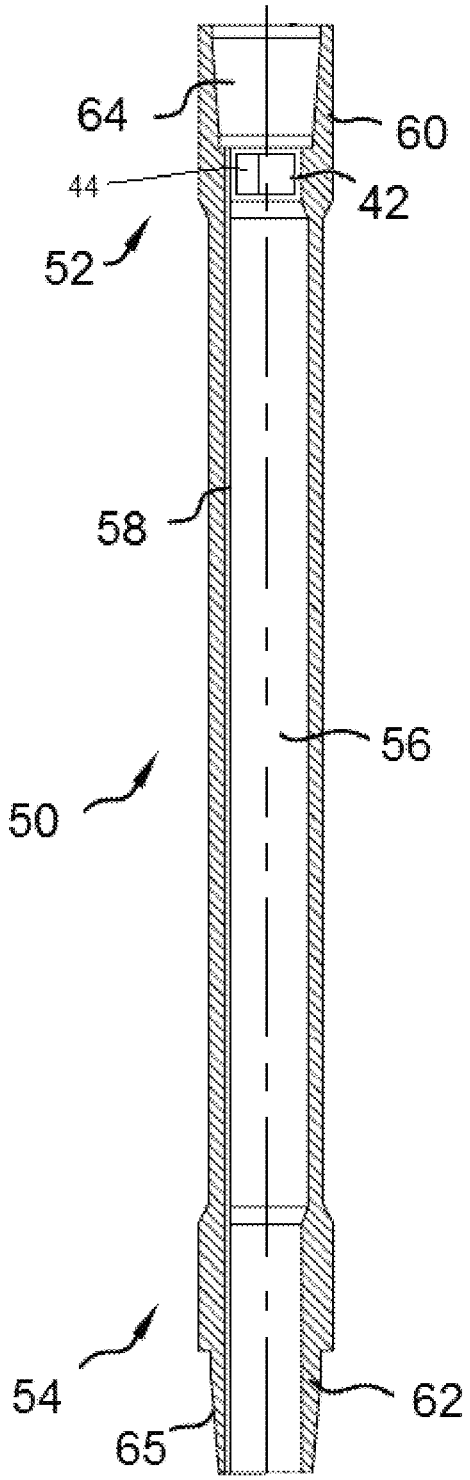
FIG. 2 depicts an embodiment of a downhole component of a downhole system.

In one embodiment, the coupler 42 and/or wireless transmission assemblies 44 are disposed at or connected to a coupling assembly of at least one wired pipe downhole component. FIG. 2 illustrates an example of a downhole component and a coupling assembly. In this example, the downhole component is a pipe segment 50, but is not so limited and can be any downhole component, such as a logging tool or BHA.

The pipe segment 50 has a first end 52 and a second end 54, and an inner bore or other conduit 56 extending along the length of the segment 50 to allow drilling mud or other fluids to flow therethrough. In one embodiment, the first end 52 is an upper end (i.e., closer to the surface along a path of the borehole) and the second end is a lower end. A coupler 42 and a wireless transmission assembly 44 are disposed at or near the upper end. A communication conduit 58 is located within the segment 50 to provide protection for electrical, optical or other conductors to be disposed along the segment 50. The segment 50 includes a coupling assembly having at least one of a first coupling 60 and a second coupling 62. The first coupling 60 includes a female coupling portion 64 having an interior threaded section, and is referred to herein as a "box". The second coupling 62 includes a male coupling portion 65 having an exterior threaded section, and is referred to herein as a "pin".

Figure 3:
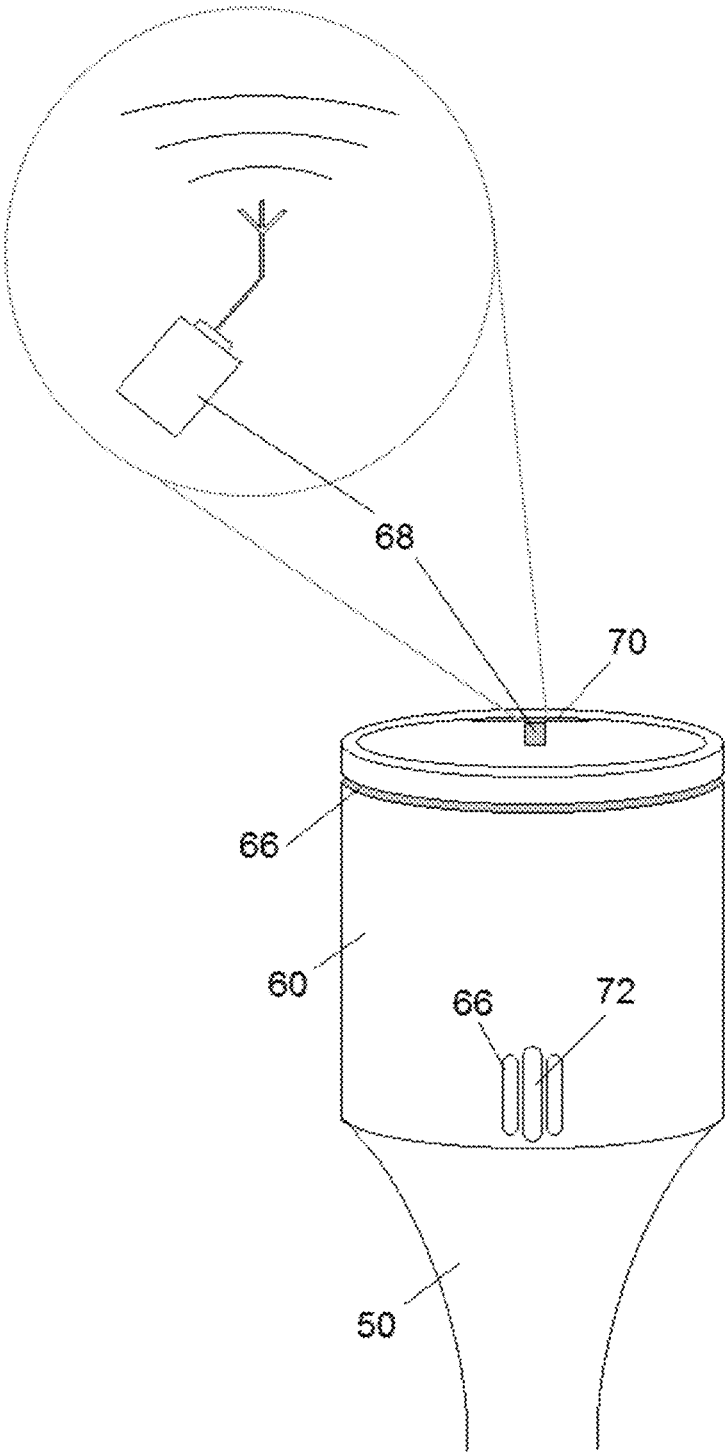
FIG. 3 depicts an embodiment of a communication assembly.

FIG. 3 shows an embodiment of a portion of the communication system, which includes a wireless transmission assembly attached to the first coupling 60 at an exterior and/or interior of the box.

The wireless transmission assembly 44 may be located at the coupling 60 or other suitable location at the pipe segment 50 or other wired pipe downhole component. For example, the wireless transmission assembly 44 includes a wireless (e.g., RF) transmitter/receiver 68 having suitable electronics and a long range antenna 69. The wireless transmission assembly 44 can be automatically activated to convert a received transmission signal based on the wired pipe downhole component being the uppermost component, and automatically deactivated based on the downhole component being no longer the uppermost component.

The wireless transmitter/receiver 68 and/or the antenna 69 may be located at the coupling 60, e.g., in the shoulder of the pipe segment 50 within the coupling 60. For example, the antenna 69 can be located in a non-conductive ring in the circumferential, axial grooves 66, or a combination thereof. In another example, the transmitter/receiver 68 and/or the antenna 69 is at another location at or in the pipe segment 50 (e.g. in a pocket in the outside surface of the pipe joint to communicate with the wireless network without breaking the connection).

In various embodiments, the coupler and the wireless transmission assembly 44 have separate antennas (i.e., a short range antenna and a long range antenna). However, in some embodiments, the wireless transmission assembly 44 and the coupler include respective electronic components connected to a single antenna.

In one example, the wireless (e.g., RF) transmitter/receiver 68 is disposed in a recess or groove 70 at or near the face of the box. An example of the wireless transmitter/receiver 68 is a 5.8 GHz transmitter/receiver antenna mounted in the connection box wall, with a range of about 100 meters, powered by a battery (e.g., a 5 volt battery). An example of a suitable size wafer transmitter receiver is about 40 mm×20 mm by 5 mm. In another example, a long range antenna 72 is disposed in one or more grooves 66 on the box. It is noted that these examples are provided for illustrative purposes, as the location and configuration of the communication components and devices are not limited to the examples and embodiments described herein.

The coupler 42 is not limited to an inductive coupler. For example, the coupler 42 may be a radio-frequency (RF) antenna, which is distinct from an inductive coupler. The radio-frequency antenna may be capable of near-field communications, or both near-field and far-field communications. Thus, the communication system and/or coupler may include a radio-frequency antenna configured for near-field (short range) communication in combination with a wireless long range transmitter/receiver antenna for far-field (long range) communication. Alternatively, the radio-frequency antenna may be used for both short range and long range communications.

The communication assembly at each location may be operably connected to adjacent couplers and wireless transmission assemblies and/or surface equipment via a conductor or conductor assembly, such as a portion of the cable 40. In one embodiment, the communication system includes one or more bus setups that include one or more communication conductors and associated hardware to transmit power, signals and/or data between communication assemblies (e.g., coupler 42 and wireless transmission assemblies 44) and/or surface equipment. For example, one or more of the wired pipe downhole components includes an instrument bus connected to communication assemblies at each end of a downhole component. Each instrument bus or other suitable bus setup may be configured to calculate or receive link budgets for wireless communication using short range (e.g., relatively low frequency or bandwidth) or long range (e.g., relatively high frequency or bandwidth) signals to ensure that sufficient power and/or a sufficient communication signal strength is available for transmission.

Figure 4:
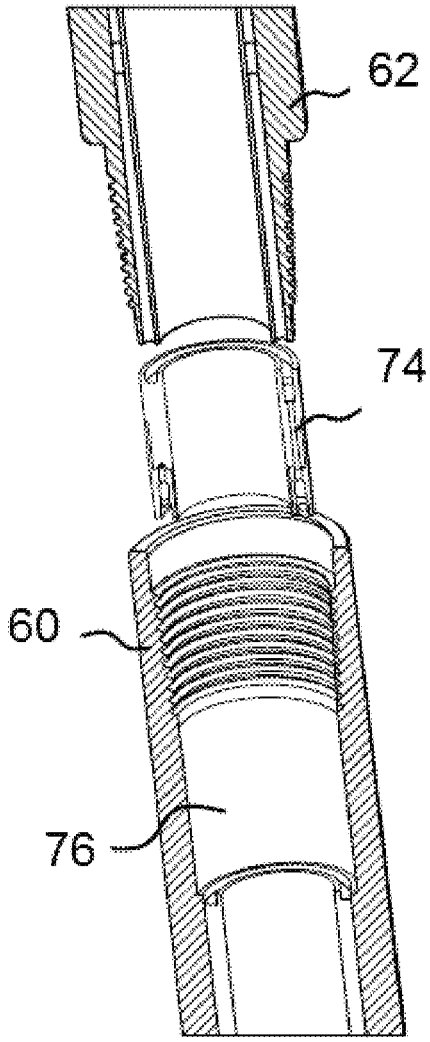
FIG. 4 depicts an embodiment of an electronic frame housing various electronic components.

FIG. 4 depicts an embodiment of the coupler and the wireless transmission assembly configured to be disposed in a removable frame 74 that is configured to be inserted or otherwise disposed in a coupling assembly and constrained by the coupling assembly when adjacent downhole components are connected. The frame 74 may be pre-sealed to provide protection from downhole fluids.

In one embodiment the communication system includes a repeater (e.g., a repeater 49 shown in FIG. 1), which can include electronics for various functions. One function of the repeater may be the amplification of the transmission signal on its way from one wired pipe downhole component to another wired pipe downhole component, passing at least one coupler. The repeater may also be provided to modulate a signal, filter a signal, truncate a signal, limit a signal and/or perform other electronic signal modifications. In some embodiments, the repeater may be located in the removable frame 74.

The frame 74 may be cylindrical and/or otherwise shaped and sized to fit within a space formed between the pin and box when connected. The frame 74 is mechanically distinct and separate from the coupling assembly and the wired pipe downhole components, and is configured to be secured at least axially based on encapsulation of the frame by the coupling assembly and/or the downhole components. Thus, the frame does not need to be directly sealed or adhered to the connection/components, but rather can rely upon the already existing sealing engagement between the components (e.g., the box-pin connection).

The frame 74 includes electronics configured to facilitate wired pipe telemetry or other communications, and also facilitate wireless communications as described herein. Exemplary electronics include repeater electronics and coupler of a signal transmission system configured to transmit power and/or communications between downhole components, and wireless transmission electronics such as an antenna, wireless modem or wireless network (e.g., W-Fi) transmitter/receiver. For example, the frame 74 includes recesses, chambers or other retaining structures to house wired and wireless communication components, and may also house power supply components (e.g., batteries)

The frame 74 may define a fluid conduit, such as an inner or central bore, that provides fluid connection between the bores of downhole components. In one embodiment, the frame 74 includes an outer surface (e.g., a cylindrical surface) that is configured to fit within a bore-back region 76 of the box.

In one embodiment, the frame 74 includes two or more parts or frame elements made from a high strength material (e.g. alloy steel or superalloy, or plastic such as organic thermoplastic polymers PEEK), i.e., a material that can withstand temperature, pressure, fluid and operational conditions experienced downhole. The frame elements are joined together to form a housing that encapsulates the electronic components and isolates the electronic components from borehole fluids and other environmental conditions. The frame elements may be mechanically joined together by a permanent mechanical joining, such as a weld or an adhesive or screwing together. Exemplary welding methods include laser or electron beam welding.

Figure 5:
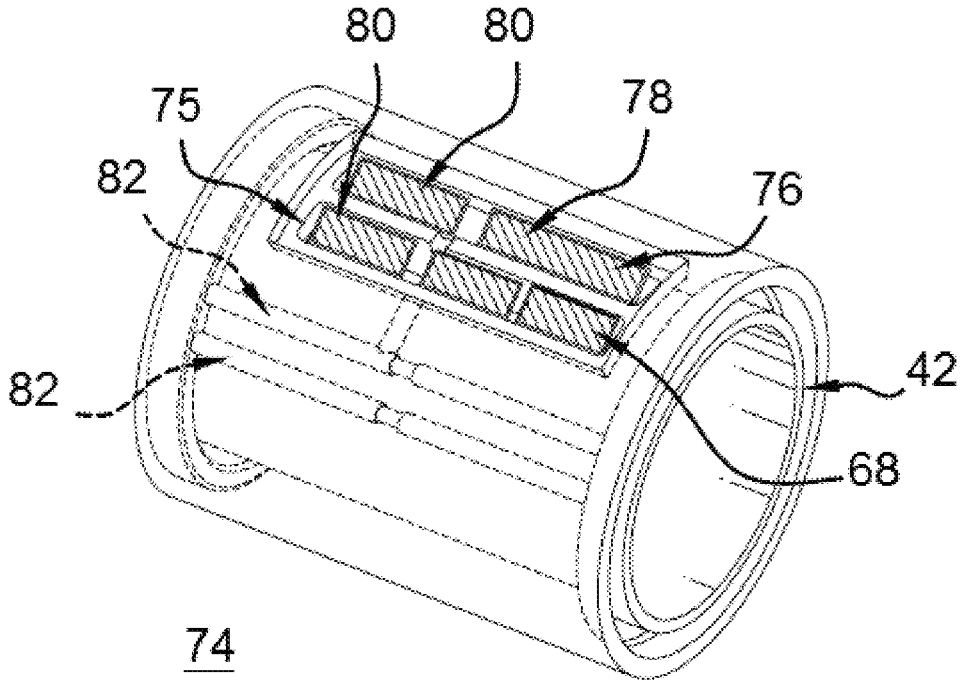
FIG. 5 depicts an example of the frame of FIG. 4 and electronic components for communication during periods of physical and/or electrical connection and disconnection of a borehole string from surface equipment.

FIG. 5 illustrates an example of the frame 74 including various retaining structures for accommodating various electronic components. Exemplary retaining structures include recesses or pockets to accommodate electronic components such as batteries, components of the repeater, and components of the wireless transmission assembly, interfaces and processing chips. For example, the frame 74 includes recesses 75 to house the wireless transmitter/receiver 68, repeater electronics 78 and batteries 80, and a coupler 42. The frame 74 may also include channels 82 to accommodate elongated components such as connectors, cables, wires, fluid conduits and optical fibers (e.g., for direct/passive signal transmission and/or active signal transmission).

It is noted that the above examples are provided for illustrative purposes, as the size, type and location of the coupler and transmitter/receiver are not limited to the embodiments and examples discussed herein. It is also noted that the wireless transmitter/receiver, antenna or other suitable wireless transmission assembly can be mounted in existing wired pipe architecture, and existing wired pipe downhole components.

Figure 6:
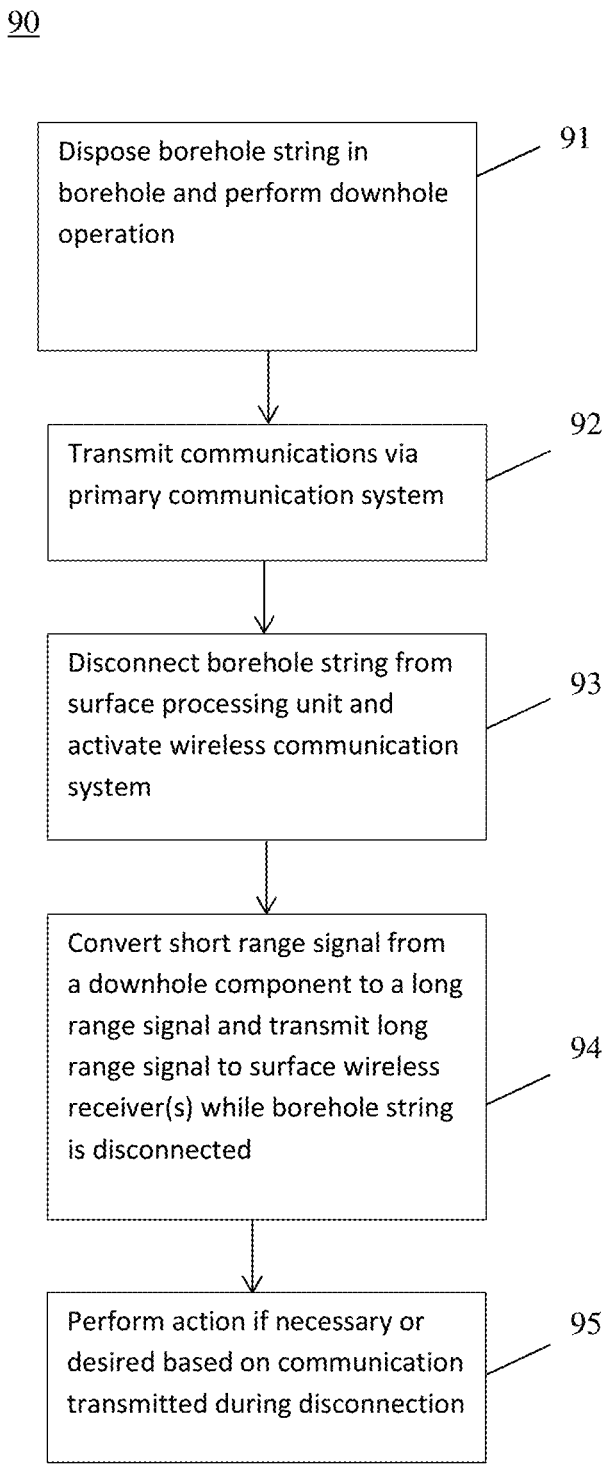
FIG. 6 depicts a flow chart providing an embodiment of a method of performing aspects of a downhole or energy industry operation.

FIG. 6 illustrates a method 90 of performing aspects of an energy industry or downhole operation. The method 90 is discussed as follows in conjunction with the system 10 and the communication system of FIG. 1, but is not so limited and may be used in conjunction with any combination of communication devices configured to convert and wirelessly transmit communications between downhole components and surface devices. The method 90 includes one or more stages 91-95. In one embodiment, the method 90 includes the execution of all of stages 91-95 in the order described. However, certain stages may be omitted, stages may be added, or the order of the stages changed.

In the first stage 91, an energy industry or downhole operation, such as a drilling operation, is performed. Exemplary operations include drilling operations, LWD operations, wireline operations, completion operations, stimulation operations and others. In one embodiment, the energy industry operation is a drilling operation that includes deploying a borehole string such as a drillstring in the borehole. Drilling mud and/or other fluids are circulated through the borehole 12 using one or more pumps. Prior to and/or during the operation, various operational parameters are selected, such as borehole trajectory, pumping speed, weight-on-bit (WOB), RPM and time parameters.

In the second stage 92, during the operation, communications are transmitted through the drillstring via a primary communication system such as a wired pipe system. In one embodiment, communications from the BHA 18 are transmitted via successive coupler 42 via short range transmission signals and through a cable connection at the surface to the surface processing unit 32. For example, transmission signals during the operation are transmitted through the wired pipe drillstring over the cable 40 via an appropriate communication protocol.

Communications are transmitted via the coupler or other primary communication device via short range transmissions between components. As described herein, a "short range transmission" refers to transmission of a signal from a transmitter to a receiver over a distance that is shorter than the distance between an uppermost wireless transmission assembly 44 and a surface wireless receiver. Short range transmissions include, for example, transmissions through physical electrical connections between components, inductive connections and/or capacitive connections, and magnetic resonance coupling, and short range or micro range wireless connections.

In the third stage 93, the drillstring is disconnected from surface equipment to, e.g., add a pipe segment or trip the drillstring from the borehole. A downhole processing device, such as the DIS 48, detects that the drillstring is disconnected and transmits an activation signal to the uppermost wireless transmission assembly 44. The activation signal is successively transmitted to each downhole component via a short range transmission until the activation signal reaches the uppermost wireless transmission assembly 44. The uppermost wireless transmission assembly may be powered by a battery in the assembly or by another downhole power source.

In one embodiment, a detection mechanism or system is included for detecting when a downhole component is the uppermost component and/or identifying which of the downhole components is the uppermost component. The detection mechanism may take various forms, such as communications between the DIS 48 and individual components that specify the location of each component.

The detection mechanism may be any device or system that allows for detecting when a component is the uppermost component and subsequent switching from short range communication to long range communication. Examples of such a mechanism include detection devices for measuring propagation line parameters such as reflection (e.g., the travel time of a signal transmitted through wired pipe to a downhole component) and/or impedance to determine when a component has been communicatively disconnected. Other examples include a sensor (e.g., a light sensor or temperature sensor) that can be analyzed to determine whether the downhole component is at the surface. Still other examples include a switch disposed with at least one wired pipe downhole component (e.g., in the downhole component shoulder) or other device that can be activated manually, such as by a manual switch, when the wired pipe downhole component is disconnected from the surface equipment to prompt activation of the uppermost wireless transmission assembly 44. Devices that are involved in the switching are referred to as switching mechanisms.

In the fourth stage 94, subsequent communications from downhole components below the uppermost component are received at the uppermost wireless transmission assembly 44 and converted by a conversion device to a long range transmission signal. A long range transmission refers to transmission of a wireless transmission signal over a longer distance than the short range transmission. Examples of long range signals include radio signals and wireless local area network (Wi-Fi, WLAN) signals transmitted from the uppermost wireless transmission assembly 44 to wireless receivers or antennas on a top drive, derrick, a local processing unit, a data center or a remote client.

For example, communications during disconnection are performed by transmitting a micro range wireless transmission signal having a first frequency (e.g., about 125 MHz) between downhole components to the uppermost wireless transmission assembly 44, and converting the micro range signal to a longer range wireless transmission signal having a different frequency (e.g., about 2.4 or 5.0 GHz) for transmission to surface receivers.

In the fifth stage 95, various actions can be performed based on information received via long range transmissions during the disconnection period. Such actions include, for example, displaying received information to a device or user, performing measurements via measurement tools or sensors (powered by downhole power source or sources), determining downhole conditions, adjusting subsequent operational parameters of the downhole operation after the borehole string is reconnected (e.g., adjusting drilling parameters), adjusting tripping parameters, downloading memories, and re-programming downhole components.

For example, interrogation of sensors downhole and transmission of data (e.g., caliper, pressure, survey data, etc.) can be performed in real time during disconnection periods. Various conditions may be monitored during disconnection, such as borehole stability changes and/or potential influxes during connections or tripping. Efficiency improvements can be made by performing transmission of survey data, tool reprogramming, downlinking, and other activities offline as opposed to on a critical path during the downhole operation.

In one embodiment, the method is performed as a logging while tripping (LWT) method that includes, e.g., real-time logging of continuous flow-off pressure while tripping and use of logging data to adjust or optimize tripping speed or a tripping schedule.

In the method 90 and other embodiments described herein, "disconnection" or a downhole component being disconnected refers to a condition where normal communications between the wired pipe downhole component and surface equipment is prevented. For example, the wired pipe downhole component can be considered to be disconnected when transmission features such as a wired pipe connection or a short range communication device (e.g., the coupler 42 or the short range antenna 72) are communicatively disconnected from surface components or are out of range of the surface components.

In one embodiment, the uppermost downhole component is disconnected when the uppermost component is physically disconnected from the surface, e.g., when a new wired pipe segment or component is being added or when tripping. For example, the uppermost component is disconnected when a drill string or other borehole string is in slips. In this case there is simply no connection to anything above the uppermost component (only air), although the drill string may remain physically connected, e.g., to a rotary table of a drilling rig.

Other instances when the uppermost component is disconnected may occur when there is a malfunction or other problem with the normal surface communication equipment (e.g., when there is a problem with a wired pipe string or a surface communication sub). This condition may be automatically or manually detected and communication via long range transmission activated.

Another example of a disconnection is a case where the normal (short range) connection is broken in the presence of an encapsulating device, such as a continuous circulation device. In this case, the pipe joint is physically disconnected but mud flow/hydraulic pressure may be continuous, and rotation may be continuous. Either the short range or the long range antenna could function in this case if a receiving (stationary) antenna is located in the continuous circulating device.

FIG. 7 shows an example of a communication device 100 incorporating features of both primary communication (i.e., short range communication) components and wireless communication components described herein. The communication device 100 is disposed in this example in the box end of a wired pipe segment, tool or other wired pipe downhole component. Also in this example, the communication device includes electronic components housed in an electronics frame (e.g., the frame 74) that houses both primary and wireless communication circuitry. The electronics frame is configured to be inserted into the box end, e.g., in a bore-back region of the box. The communication device is also referred to herein as a microrepeater (μR) 102. The communication device may be incorporated into or connected to a bus setup, such as downhole instrument buses disposed internally in one or more wired pipe downhole components (e.g., in each downhole tool and/or BHA).

The microrepeater 102 houses circuitry that includes a repeater circuit 104 configured to receive a short range transmission from an adjacent component via, e.g., a conductor located along the adjacent component and a coupler or other internal receiver for detecting a short range transmission (e.g., a 125 MHz signal). Wireless transmission circuitry is disposed in the microrepeater, with the repeater circuit as an integrated circuit, chip or board, or disposed as a standalone component.

The microrepeater also houses wireless transmission circuitry. In the example of FIG. 7, the wireless transmission circuitry includes a wireless local area network (i.e., Wi-Fi, WLAN) circuit 106 coupled to a matching network circuit 108. Both the repeater circuit 104 and the matching network circuit 108 are connected to a diplexer 110 that is configured to convert or filter signals depending on whether the signal is received from the repeater circuit 104 or the matching network circuit 108. The diplexer 110 filters or converts received signals to a transmission having one of a plurality of frequencies, and the converted signal is transmitted wirelessly from an antenna 112. In this example, the diplexer converts the transmission to one of a short range frequency (Frequency A) and a long range frequency (Frequency B). It is noted that the communication device 100 and/or the wireless transmission circuitry can be considered the conversion device.

In use, during a downhole operation where a borehole string is connected to the surface, the repeater circuit 104 receives communications (e.g., downhole data from a measurement tool, BHA or other component) from adjacent downhole components and sends a short range transmission signal having a first frequency (e.g., 125 MHz) via the diplexer 110 to the antenna 112. The transmission signal is sent to another component as a short range wireless signal. During the downhole operation, the Wi-Fi circuit 106 is in a standby, dormant or survival mode.

When the borehole string is disconnected, a downhole processor such as a DIS detects the disconnection and sends a command to the repeater circuit 104, which sends an activation or "Wake Up" signal from a controller 114 that causes the Wi-Fi circuit 106 to be activated. Downhole data or other communications are routed to the Wi-Fi circuit 106 and to the diplexer 110, which converts the communications to a long range wireless transmission signal having a second frequency (e.g., 5.0 GHz) and transmits the long range signal via the antenna 112 to a surface receiver.

Any suitable frequency or frequency range can be employed for the short range signal and the long range signal. Examples of one or more frequencies that can be used for the short range signal include a frequency or frequencies that are less than or equal to about 200 MHz, and examples of one or more frequencies that can be used for the long range signal include a frequency or frequencies that are greater than or equal to about 2.0 GHz. It is noted that these examples are provided for illustrative purposes; embodiments described herein are not limited to the examples discussed herein.

In the example of FIG. 7, the wireless transmission circuitry is disposed in an existing microrepeater and uses existing cable paths for primary communications and an existing antenna that is used for both short range and long range communications. The wireless transmission circuitry can be incorporated with existing repeater circuitry in other ways. For example, standalone wireless transmission circuitry (e.g., LWT circuitry) is incorporated in the microrepeater of FIG. 7 using existing cable paths and a new additional antenna on the coupler. In another example, standalone wireless transmission circuitry is incorporated with existing repeater circuitry using an additional cable path and a new additional antenna on the coupler. In yet another example, the wireless transmission circuitry can be incorporated with existing repeater circuitry without an additional pipe external communication device (e.g., an additional antenna). In this case the repeater circuitry supports wireless transmission.

As shown in the example of FIG. 7, a repeater assembly such as the microrepeater 102 includes repeater circuitry for short range transmission and separate wireless circuitry for long range transmission, along with a single antenna or transmitter for transmission of both long range and short range signals. The separate wireless circuitry shown in FIG. 7 and otherwise described herein may be standalone electronics or circuitry. A "standalone" circuit or component refers to a circuit or component that can be operated independently from other components such as the repeater circuitry.

Figure 8:
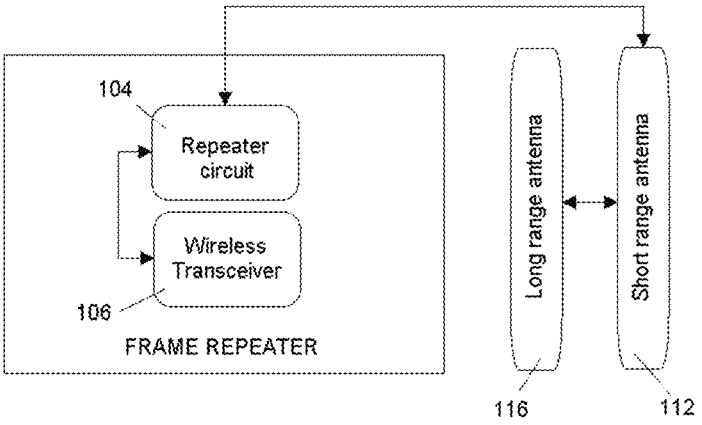
FIG. 8 depicts an example of a communication device that includes circuitry for both short range communication and long range communication according to embodiments described herein.
Figure 9:
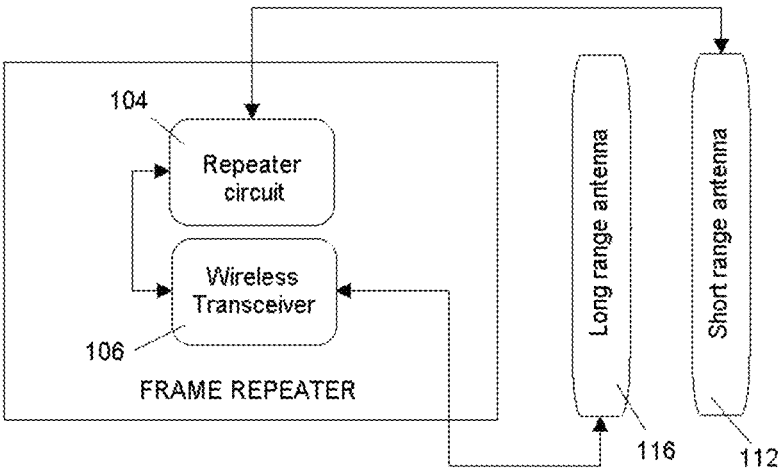
FIG. 9 depicts an example of a communication device that includes circuitry for both short range communication and long range communication according to embodiments described herein.
Figure 10:
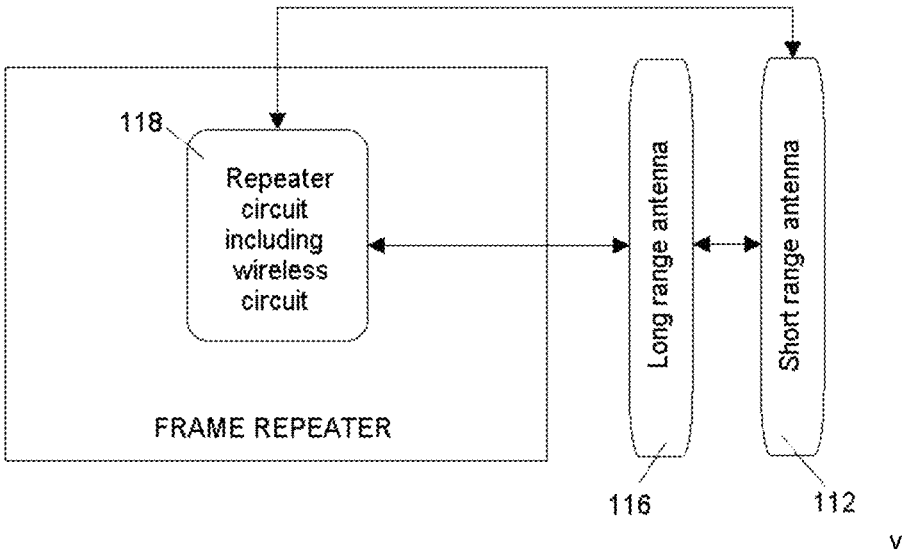
FIG. 10 depicts an example of a communication device that includes circuitry for both short range communication and long range communication according to embodiments described herein.

FIGS. 8-10 illustrate alternative configurations of the microrepeater (or other suitable communication frame or assembly). In the example of FIG. 8, the microrepeater includes separate circuitry 106 for wireless communication and an additional antenna 116 for long range transmission. The antenna 112 is configured as a short range antenna for transmission between downhole components. The wireless circuitry 106 is connected through the repeater circuit 104 and through existing cable or conductor paths, and the long range antenna 116 is electrically connected to the existing cable paths through the short range antenna 112

In the example of FIG. 9, the microrepeater includes separate wireless circuitry 106 that is directly connected to the long range antenna 116 through a new cable or conductor path that is different than the path between the repeater circuit 104 and the antenna 112. In the example of FIG. 10, the microrepeater does not have standalone wireless circuitry, but rather includes combined circuitry 118 configured to process both short range and long range communications. It is noted that the configuration of the microrepeater and other communication assemblies described herein are not limited to any specific examples.

Figure 11:
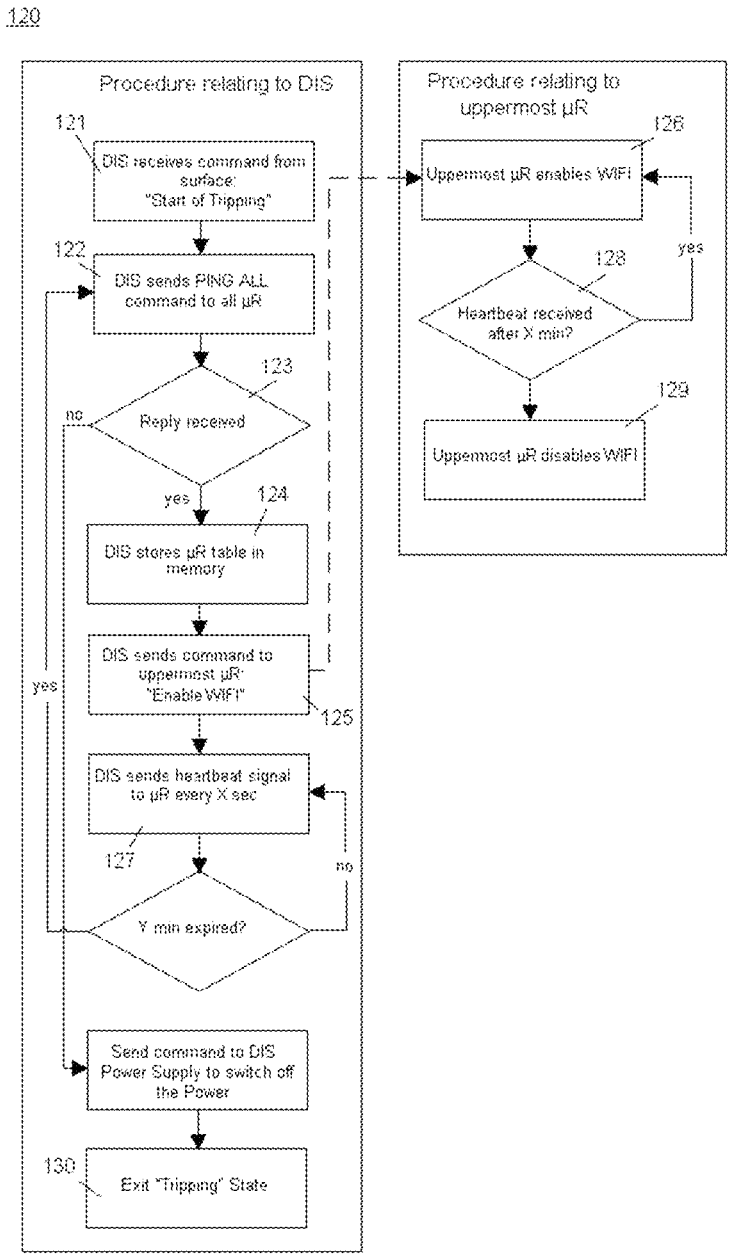
FIG. 11 depicts a flow chart providing an example of a method of communicating between a downhole device and a surface device during a period when a borehole string is physically and/or electrically disconnected from surface equipment.

FIG. 11 depicts an example of a method 120 for communicating with surface devices during a disconnection period. In this example, borehole string such as the drillstring of FIG. 1 includes a plurality of wired pipe downhole components. The lowermost wired pipe downhole component and each successive downhole component include a transmission device such as a microrepeater. A downhole controller (e.g., a DIS) is disposed at or adjacent to the lowermost downhole component is communicatively coupled to each downhole component via wired pipe components or short range wireless components. The downhole controller is battery powered to keep the network running and will schedule/control the string to enable/disable functions of the microrepeaters.

As discussed above, any single repeater is able to act like the uppermost communication element on its own. During normal operation when the borehole string is connected to the surface, long range wireless circuitry in each microrepeater is in survival mode. During disconnection periods, the long range wireless electronics may be continuously activated and powered, or may be activated and powered during relatively short periods (e.g., during tripping and only when data is necessary or desired) to save battery power.

In this example, a DIS receives a command or message from a surface processing device (described in this example as a surface interface sub (SIS)) that the borehole string is to be disconnected (block 121). For example, the string is disconnected for tripping and sends a "start of tripping" command to the DIS. The DIS sends a message (e.g., a PING ALL command) to each microrepeater (block 122) and receives replies from each microrepeater (block 123). The DIS then stores information from each microrepeater, e.g., in a table, to allow for identification of the relative position of each microrepeater (block 124), and sends a command to the uppermost microrepeater to activate the long range wireless circuitry (e.g., Wi-Fi, WLAN) circuitry therewith (block 125). The uppermost microrepeater activates Wi-Fi in response to the command (block 126).

During the disconnection period, the DIS sends a periodic signal (referred to in this example as a heartbeat signal) to inform the uppermost microrepeater that the disconnection period remains in effect (block 127). The uppermost microrepeater continues its operation as long as a heartbeat signal is received after a selected period (128), and discontinues Wi-Fi if the heartbeat is not received after the selected period (129). Upon reconnection of the borehole string, the DIS deactivates the uppermost microrepeater and normal communication is re-established (block 130).

Set forth below are some embodiments of the foregoing disclosure:

Embodiment 1

A communication system for communicating between a wired pipe string in a borehole and a surface location, comprising: at least a first wired pipe downhole component and a second wired pipe downhole component in the wired pipe string; a coupler configured to transmit a transmission signal between the first wired pipe downhole component and the second wired pipe downhole component; and a wireless transmission assembly in at least one of the first wired pipe downhole component and the second wired pipe downhole component, the wireless transmission assembly configured to wirelessly transmit a wireless transmission signal to a receiver antenna, the receiver antenna disposed at the surface location and configured to receive the wireless transmission signal.

Embodiment 2

The system of any prior embodiment, further comprising a conversion device, the conversion device configured to convert the transmission signal from a wired electrical signal to an electrical wireless transmission signal.

Embodiment 3

The system of any prior embodiment, further comprising a conversion device, the conversion device configured to convert the transmission signal from a short range electrical wireless signal having a first range to a long range electrical wireless signal having a second range.

Embodiment 4

The system of any prior embodiment, wherein the coupler is configured to transmit the transmission signal at a first frequency, and the wireless transmission assembly is configured to transmit the wireless transmission signal at a second frequency that is different than the first frequency.

Embodiment 5

The system of any prior embodiment, further comprising a switching mechanism configured to convert the transmission signal to the wireless transmission signal in response to at least one of: a message from a downhole processing device and a signal from a manual switch.

Embodiment 6

The system of any prior embodiment, wherein the first wired pipe downhole component or the second wired pipe downhole component is an uppermost wired pipe downhole component.

Embodiment 7

The system of any prior embodiment, further comprising a detection mechanism configured to perform at least one of: detecting when the first or second wired pipe downhole component is the uppermost component and identifying which of the first and second wired pipe downhole components is the uppermost component.

Embodiment 8

The system of any prior embodiment, further comprising at least one sensor, the at least one sensor selected from at least one of: a pressure sensor, a temperature sensor, a magnetometer, an accelerometer, a formation evaluation sensor, a bending sensor and a cement evaluation sensor, the wireless transmission signal configured to transmit data provided by the at least one sensor.

Embodiment 9

The system of any prior embodiment, wherein the wireless transmission assembly is a bi-directional wireless transmission assembly.

Embodiment 10

The system of any prior embodiment, wherein the wireless transmission assembly is located at one of: the coupler, an outer surface of the first wired pipe downhole component or the second wired pipe downhole component, and an inner surface of the first wired pipe component or second wired pipe downhole component.

Embodiment 11

The system of any prior embodiment, wherein the wireless transmission assembly is part of a wireless network.

Embodiment 12

The system of any prior embodiment, wherein the wired pipe string is used in a tripping operation.

Embodiment 13

A method of communicating between a wired pipe string in a borehole and a surface location, comprising: disposing the wired pipe string in a borehole in an earth formation and connecting the wired pipe string to surface equipment, the wired pipe string including at least a first wired pipe downhole component and a second wired pipe downhole component, and a coupler configured to transmit a transmission signal between the first wired pipe downhole component and the second wired pipe downhole component; and transmitting a wireless transmission signal from a wireless transmission assembly in at least one of the first wired pipe downhole component and the second wired pipe downhole component, the wireless transmission signal transmitted to a receiver antenna disposed at the surface location.

Embodiment 14

The method of any prior embodiment, further comprising receiving the transmission signal at a conversion device, and converting the transmission signal to the wireless transmission signal.

Embodiment 15

The system of any prior embodiment, wherein converting is performed in response to at least one of: a message from a downhole processing device and a signal from a manual switch.

Embodiment 16

The method of any prior embodiment, further comprising receiving the transmission signal at a conversion device, and converting the transmission signal from a short range electrical wireless signal having a first range to a long range electrical wireless signal having a second range, the first range being less than the second range.

Embodiment 17

The method of any prior embodiment, wherein the transmission signal is transmitted at a first frequency, the method further comprising receiving the transmission signal at a conversion device, and converting the transmission signal to the wireless transmission signal having a second frequency that is different than the first frequency.

Embodiment 18

The method of any prior embodiment, wherein transmitting the wireless signal is performed based on the first wired pipe downhole component or the second wired pipe downhole component being an uppermost wired pipe downhole component.

Embodiment 19

The method of any prior embodiment, further comprising a detection mechanism configured to perform at least one of: detecting when the first or second wired pipe downhole component is the uppermost component and identifying which of the first and second wired pipe downhole components is the uppermost component.

Embodiment 20

The method of any prior embodiment, wherein the wireless transmission signal is configured to transmit data from a sensor disposed at a downhole location.

Generally, some of the teachings herein are reduced to an algorithm that is stored on machine-readable media. The algorithm is implemented by a computer or processor such as the surface processing unit 28 and provides operators with desired output.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A communication system for communicating between a wired pipe string in a borehole and a surface location, comprising:

at least a first wired pipe downhole component and a second wired pipe downhole component in the wired pipe string, wherein at least one of the first wired pipe downhole component and the second wired pipe downhole component is an uppermost wired pipe downhole component, the uppermost wired pipe downhole component including an upper end and a lower end;

a coupler in the upper end of the uppermost wired pipe downhole component, the coupler configured to transmit a transmission signal between the first wired pipe downhole component and the second wired pipe downhole component; and a transmission assembly proximate to the upper end of the uppermost wired pipe downhole component, the transmission assembly including a transmitter configured to wirelessly transmit the transmission signal to a receiver antenna when the uppermost wired pipe downhole component and the transmission assembly are at a first surface location, the receiver antenna disposed at a second surface location and configured to receive the transmission signal.

2. The system of claim 1, further comprising a surface communication interface at a third surface location configured to communicate with the bottom hole assembly through the wired pipe string using the transmission signal, wherein the transmitter is configured to transmit a transmission signal and the receiver antenna is configured to receive the transmission signal when the uppermost wired pipe downhole component is physically disconnected from the surface communication interface.

3. The system of claim 1, further comprising a conversion device, the conversion device configured to convert the transmission signal from a short range electrical wireless signal having a first range to a long range electrical wireless signal having a second range.

4. The system of claim 1, wherein the coupler is configured to transmit the transmission signal at a first frequency, and the transmission assembly is configured to transmit the transmission signal at a second frequency that is different than the first frequency.

5. The system of claim 1, further comprising a switching mechanism configured to convert the transmission signal to the wirelessly transmitted transmission signal in response to at least one of: a message from a downhole processing device and a signal from a manual switch.

6. The system of claim 1, further comprising a detection mechanism configured to perform at least one of: detecting when the first or second wired pipe downhole component is the uppermost wired pipe downhole component and identifying which of the first and second wired pipe downhole components is the uppermost wired pipe downhole component.

7. The system of claim 6, further comprising a switching mechanism configured to switch from communication using the coupler to communication using the transmission assembly based on a signal from the detection mechanism.

8. The system of claim 1, further comprising at least one sensor, the at least one sensor selected from at least one of: a pressure sensor, a temperature sensor, a magnetometer, an accelerometer, a formation evaluation sensor, a bending sensor and a cement evaluation sensor, the transmission signal configured to transmit data provided by the at least one sensor.

9. The system of claim 1, wherein the transmission assembly is a bi-directional transmission assembly.

10. The system of claim 1, wherein the transmission assembly is located at one of: the coupler, an outer surface of the uppermost wired pipe downhole component, and an inner surface of the uppermost wired pipe downhole component.

11. The system of claim 1, wherein the transmission assembly is part of a wireless network.

12. The system of claim 1, wherein the wired pipe string is used in a tripping operation.

13. The system of claim 2, wherein the uppermost wired pipe downhole component is physically disconnected from the surface communication interface when the uppermost wired pipe downhole component is unable to communicate with the surface communication interface using a wired communication device, or a short range communication device.

14. A method of communicating between a wired pipe string in a borehole and a surface location, comprising:

disposing the wired pipe string in a borehole in an earth formation and connecting the wired pipe string to surface equipment, the wired pipe string including at least a first wired pipe downhole component and a second wired pipe downhole component, wherein at least one of the first wired pipe downhole component and the second wired pipe downhole component is an uppermost wired pipe downhole component, the uppermost wired pipe downhole component including an upper end and a lower end, and a coupler in the upper end of the uppermost wired pipe downhole component, the coupler configured to transmit a transmission signal between the first wired pipe downhole component and the second wired pipe downhole component; and wirelessly transmitting the transmission signal from a transmitter of a transmission assembly proximate to the upper end of the uppermost wired pipe downhole component when the uppermost wired pipe downhole component and the transmission assembly are at a first surface location, the transmission signal wirelessly transmitted to a receiver antenna disposed at a second surface location.

15. The method of claim 14, further comprising receiving the transmission signal at a conversion device, and converting the transmission signal to the wirelessly transmitted transmission signal.

16. The method of claim 15, wherein converting is performed in response to at least one of: a message from a downhole processing device and a signal from a manual switch.

17. The method of claim 14, further comprising receiving the transmission signal at a conversion device, and converting the transmission signal from a short range electrical wireless signal having a first range to a long range electrical wireless signal having a second range, the first range being less than the second range.

18. The method of claim 14, wherein the transmission signal is transmitted at a first frequency by the coupler, the method further comprising receiving the transmission signal at a conversion device, and converting the transmission signal to the wirelessly transmitted transmission signal having a second frequency that is different than the first frequency.

19. The method of claim 14, further comprising a detection mechanism configured to perform at least one of: detecting when the first or second wired pipe downhole component is the uppermost wired pipe downhole component and identifying which of the first and second wired pipe downhole components is the uppermost wired pipe downhole component.

20. The method of claim 14, wherein the coupler and the wireless transmission assembly are disposed at a coupling assembly at the upper end, the coupling assembly configured to physically connect the first wired pipe downhole component to another downhole component.

* * * * *